US007648111B2

(12) United States Patent
Goldstein

(10) Patent No.: US 7,648,111 B2
(45) Date of Patent: Jan. 19, 2010

(54) APPARATUS AND METHOD FOR HANGING SUPPLEMENTAL SETS OF CURTAINS

(75) Inventor: Allan Goldstein, Old Tappan, NJ (US)

(73) Assignee: Source Global Enterprises, Inc., Bronx, NY (US)

( * ) Notice: Subject to any disclaimer, the term of this patent is extended or adjusted under 35 U.S.C. 154(b) by 100 days.

(21) Appl. No.: 10/925,062

(22) Filed: Aug. 24, 2004

(65) Prior Publication Data

US 2005/0218283 A1 Oct. 6, 2005

(51) Int. Cl.
*A47H 1/10* (2006.01)
*E04G 25/00* (2006.01)

(52) U.S. Cl. ..... 248/261; 248/200.1; 248/215; 248/251; 403/292

(58) Field of Classification Search ..... 248/251, 248/261–265, 216.1, 238, 214–215, 200–200.1; 16/87 R, 95 D; 211/123, 193, 105.1, 106.1, 211/182, 86, 124; 160/123–126; 403/292, 403/315, 294, 295, 107, 293; 182/107, 121; 24/569

See application file for complete search history.

(56) References Cited

U.S. PATENT DOCUMENTS

| | | | | | |
|---|---|---|---|---|---|
| 328,999 | A | * | 10/1885 | Ballmann | 248/238 |
| 1,374,060 | A | * | 4/1921 | Chute | 24/569 |
| 1,832,086 | A | * | 11/1931 | Boye | 248/263 |
| 2,528,358 | A | * | 10/1950 | Grass | 248/251 |
| 3,043,438 | A | * | 7/1962 | Chmielewski | 211/105.6 |
| 4,047,687 | A | * | 9/1977 | Turner | 248/318 |
| 4,474,299 | A | * | 10/1984 | Andrews | 211/193 |
| 4,488,651 | A | * | 12/1984 | Bishop | 211/105.6 |
| D326,603 | S | * | 6/1992 | Rogers | D8/373 |
| 5,170,974 | A | * | 12/1992 | Ruggiero | 248/251 |
| 5,546,639 | A | * | 8/1996 | Lacore et al. | 24/265 H |
| 6,089,350 | A | * | 7/2000 | Hankins | 182/107 |
| 6,145,677 | A | * | 11/2000 | Corniel | 211/105.1 |
| D468,193 | S | * | 1/2003 | Ohm et al. | D8/376 |
| D468,623 | S | * | 1/2003 | Ohm et al. | D8/367 |
| 6,848,159 | B2 | * | 2/2005 | Bascom et al. | 29/402.08 |
| 2005/0218283 | A1 | * | 10/2005 | Goldstein | 248/251 |

FOREIGN PATENT DOCUMENTS

| | | | |
|---|---|---|---|
| EP | 0431738 | * | 6/1991 |
| GB | 2201716 | * | 9/1988 |

* cited by examiner

*Primary Examiner*—Amy J. Sterling
*Assistant Examiner*—Tan Le
(74) *Attorney, Agent, or Firm*—Theresa O'Rourke Nugent; Nugent + Smith, LLP

(57) ABSTRACT

An end of a curtain rod is provided with a hook for grasping a mounting tube extending transversely from a wall-mounted flange. The hook may be offset from the longitudinal axis of the curtain rod to permit two rods with similar offset hooks to the mounted end to end, in axial alignment, on a common mounting tube. Alternatively, one rod may be provided with a centrally mounted hook and the other rod with a claw having spaced hooks for receiving the single centrally mounted hook of an axially aligned rod therebetween. Each hook an claw may be mounted on a connector which can be fitted over the end of a segment of a tubular curtain rod, with or without an adapter, depending upon whether the segment is an inner segment or outer segment of a telescoping curtain rod.

17 Claims, 12 Drawing Sheets

APPARATUS AND METHOD FOR HANGING SUPPLEMENTAL SETS OF CURTAINS

BACKGROUND OF THE INVENTION

The present invention is directed to apparatus and a method for hanging one or more supplemental sets of curtains in an installation in which a main set of curtains has already been hung. More specifically, the invention teaches a method and an apparatus construction which enables a supplemental curtain rod to be mounted on brackets which have been used to support a main curtain rod. Only one set of brackets, i.e., the brackets on which the main curtain rod is mounted, need be affixed to a wall or ceiling no matter how many sets of curtains are to be hung.

It is known in the art to hang curtains from a wall or ceiling by suspending the curtains on a main rod which is connected to a respective bracket at each of its ends, the brackets being attached to a mounting surface, i.e., on a wall or ceiling, by screws threaded into holes drilled in the mounting surface. Where the main rod is very long, one or more additional brackets may be mounted on the wall or ceiling intermediate the end brackets to prevent sagging of the main rod and curtains.

It is also known to hang two or more sets of curtains, each set on a separate rod, with each separate rod being mounted on a respective pair of brackets screwed into the mounting surface of the wall or ceiling. Prior art rods and brackets for hanging multiple sets of curtains require a separate set of brackets for each rod, which must be affixed to a mounting surface by making separate holes for each bracket. When multiple prior art rods are used, each must be of a different length, with the outermost being the longest, and the innermost being the shortest, in order for its brackets to have access to the mounting surface.

U.S. patent application Ser. No. 09/918,448, Publication No. 2003/0024893, by Ellbogen discloses hook-like clips which can be snapped onto the cylindrical shaft of a wall bracket extending from a wall-mounted flange. Ellbogen's adapters have a tongue which is inserted into the end of a hollow supplemental curtain rod. Ellbogen also discloses the end-to-end placement of supplemental curtain rods for obtaining support in the middle of an installation of great width. However, Ellbogen teaches the use of a single clip having tongues extending from opposite ends for receiving the respective ends of two curtain rods. Such dual tongued clips are unsuitable for use on an end of a curtain rod which is not mounted adjacent an end of an axially aligned rod as the exposed unused tongue is unsightly, and may caused injury.

SUMMARY OF THE INVENTION

The present invention overcomes the aforestated disadvantages of the prior art in enabling one or more supplemental curtain rods to be supported on the main brackets of a main curtain rod installation in front of or behind the main curtain rod whereby a corresponding supplemental set of curtains can be hung in front of or behind the main curtains which have been suspended from the main curtain rod. In accordance with the invention, the main curtain rod may, optionally, be identical to the supplemental curtain rods and mounted in the same manner as the supplemental curtain rods are mounted, as explained below.

Moreover, in installations requiring an intermediate bracket to support the main rod, a supplemental curtain rod can be formed from longitudinally adjacent rod segments each of which has an end supported on the intermediate bracket. This is accomplished by the use of like connectors having offset hooks which can be attached to a common support side-by-side for mounted adjacent curtain rods in axial alignment, or a combination of a connector with a centered hook on one rod, and a claw with space hooks on the adjacent rod for receiving the centered hook therebetween.

It is therefore an object of the invention to provide a curtain rod with fasteners at its end which can enable the rod to be easily removably mounted adjacent parallel rods on a common set of wall brackets.

Another object of the invention to provide a curtain rod with fasteners at its end which can enable the rod to be easily removably mounted in end to end alignment with another rod on a common intermediate wall bracket.

Still another object of the invention to provide a curtain rod with fasteners at its end which can enable the rod to be easily removably mounted in end to end alignment with another rod on a common intermediate wall bracket or alone on an end wall bracket.

A further object of the invention is to provide a curtain rod which can make use of the same adapters whether or not the ends of the rods are the be affixed to wall mounted end brackets or intermediate brackets.

Still a further object of the invention to provide end fasteners for a curtain rod which can be mounted on both a hollow and a sold curtain rod.

DESCRIPTION OF THE PREFERRED EMBODIMENTS

Figure 1A:
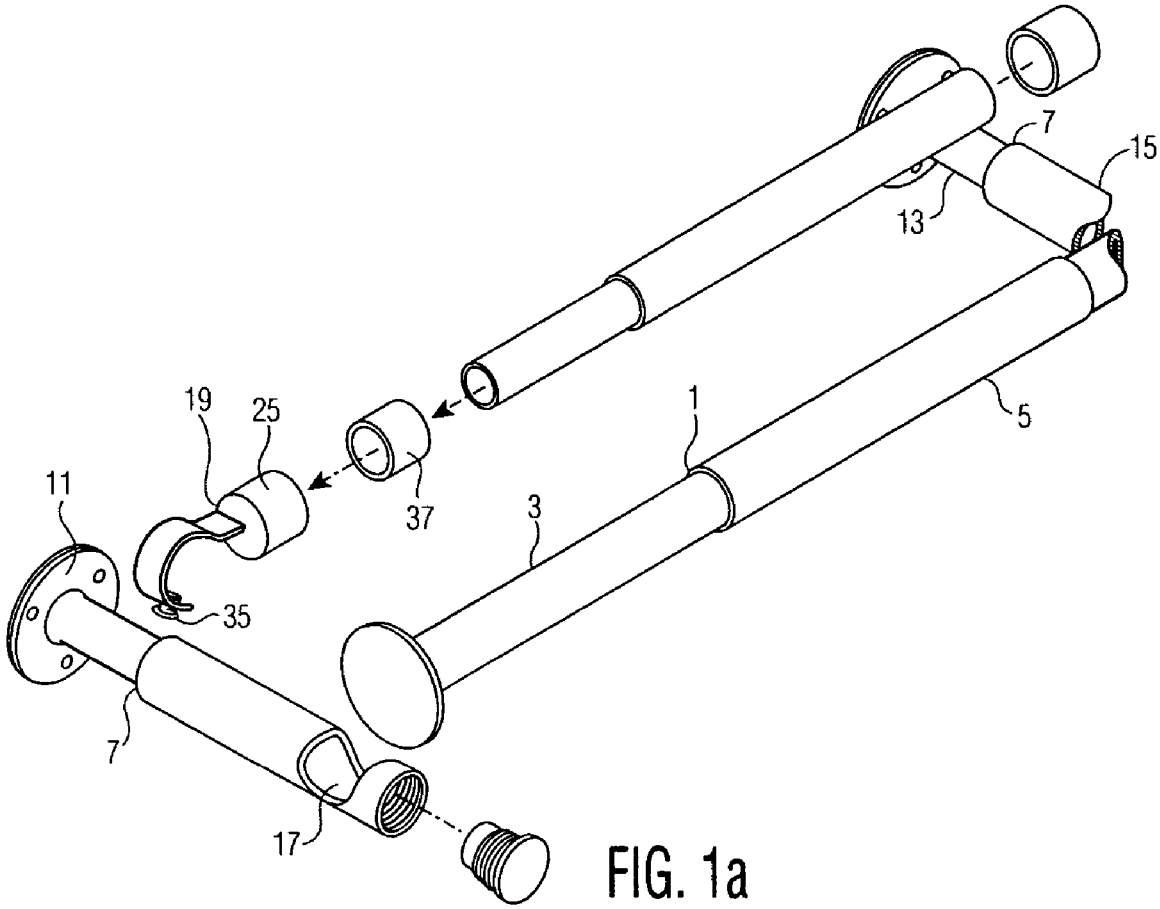
FIG. 1*a* is an exploded perspective view of a first preferred embodiment of the invention.
Figure 1B:
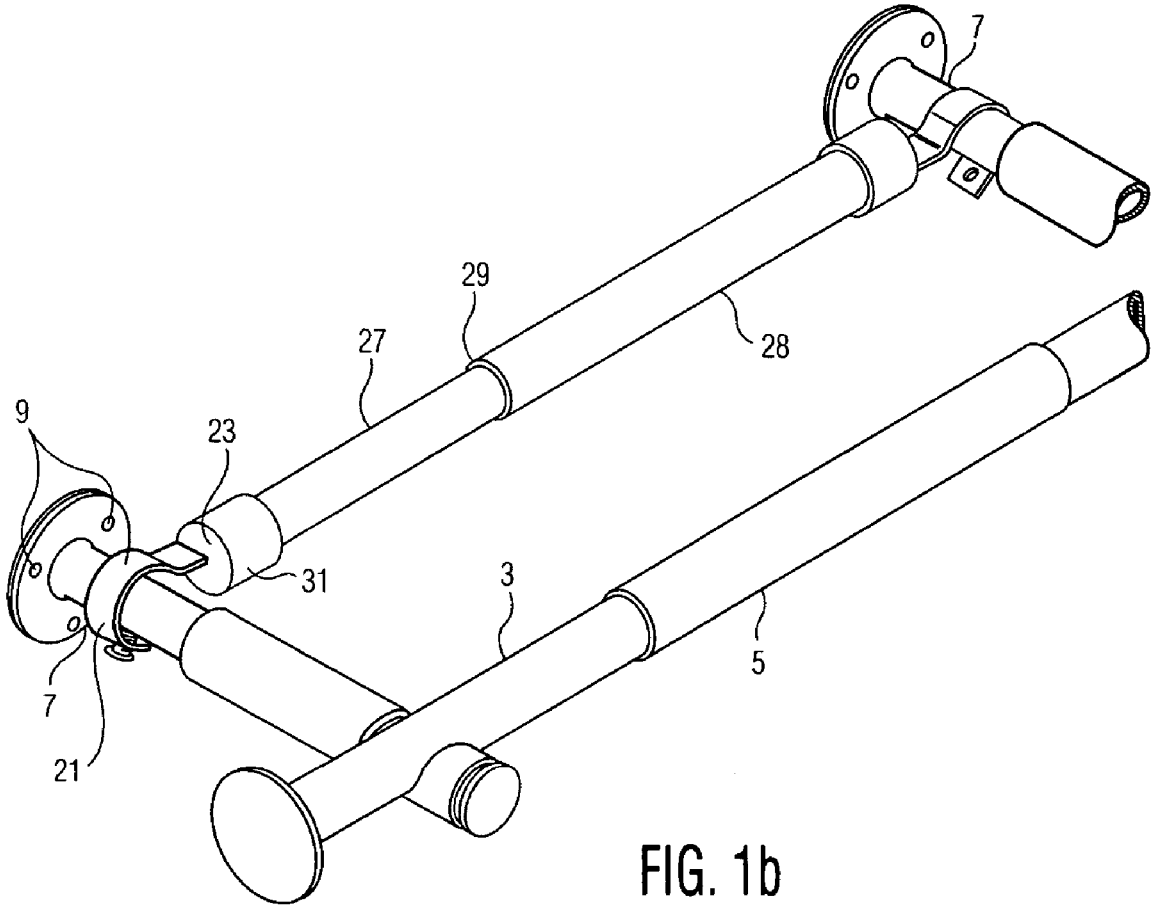
FIG. 1*b* is a perspective of the first preferred embodiment of the invention.

Referring now to FIGS. 1*a*, 1*b*, there is shown a main curtain rod 1 having telescoping segments, 3,5. Each of the end segments 3,5 is supported on a main end bracket 7 which has apertures 9 for receiving screws (not shown) in order to mount the main bracket 7 on the surface of a wall, e.g., adjacent and above an upper corner of a window.

In the embodiment shown in FIGS. 1*a*, 1*b*, the main bracket 7 has a circular flange 11 in which the apertures 9 are drilled. Affixed to the center of the flange 11 is an inner cylindrical tube 13 over which there is slidably mounted a hollow outer cylindrical tube 15. A portion of the outer cylindrical tube is cut away to form a notch 17 for receiving the tubular curtain rod. Typically two identical brackets 7 are used proximate respective ends of the main rod 1 to support the main rod 1 and a main set of curtains (not shown) hung from the main rod 1.

Figure 2:
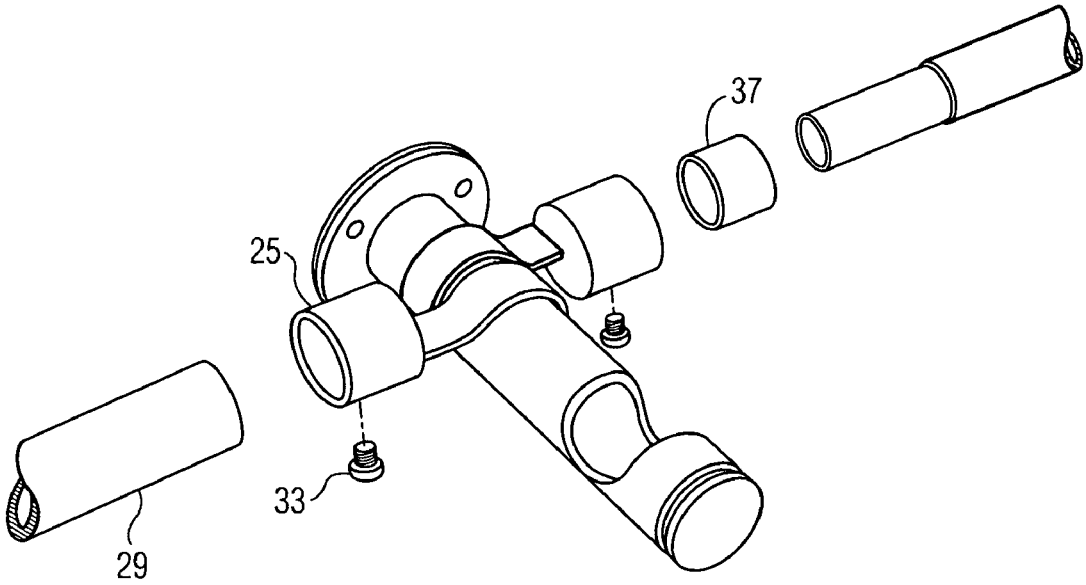
FIG. 2 is an exploded perspective view of a portion of the first preferred embodiment of the invention.
Figure 3:
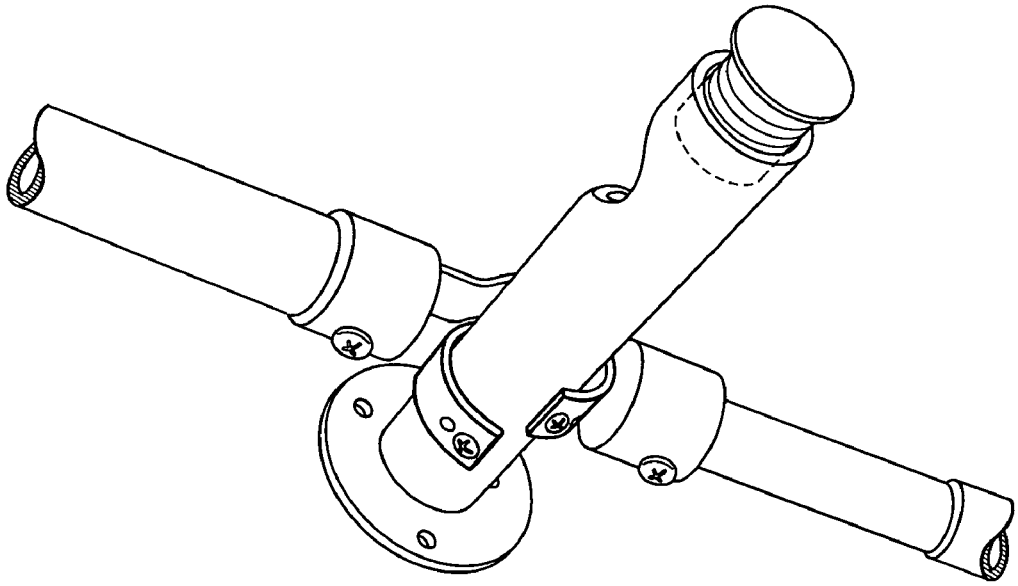
FIG. 3 is a perspective view of a portion of the first preferred embodiment of the invention.

In the embodiment of the invention shown in FIGS. 1*a*, 1*b*, there is removably mounted on the inner cylindrical tube 13 of each bracket 7 a connector 19 having a hook 21 extending from the closed end 23 of a hollow cylindrical end cap 25 in which one end of a hollow cylindrical segment 27 of a supplemental curtain rod 29 is received. The cylindrical wall 31 of each end cap 25 can be apertured for receiving a set screw 33 (see FIGS. 2 and 3) which may be tightened against the outer cylindrical wall of the supplemental curtain rod 29 received within the end cap 25 for securing the connector 19 to the supplemental rod 29.

The hook 21 is formed from a rectangular metal member bent to conform to the outer circumference of the inner cylindrical tube. Each end of the supplemental curtain rod 29 is supported on the brackets 7 by a connector 19 hooked onto the outer circumference of the bracket 7's inner cylindrical tube 13.

Figure 4:
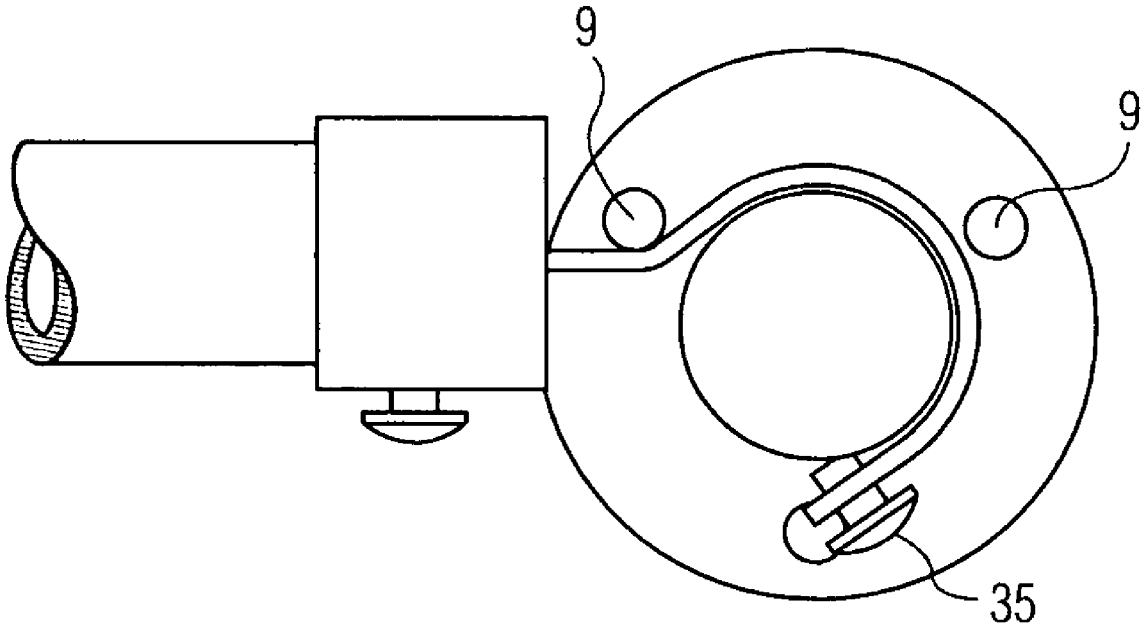
FIG. 4 is an elevation view of a portion of the first preferred embodiment of the invention.

The hook 21 may, optionally be apertured to receive a set screw 35 (see FIG. 4) for affixing the supplemental rod 29 to the bracket 7 and preventing unwanted relative movement between the hook 21 and inner cylindrical tube 13.

Figure 1C:
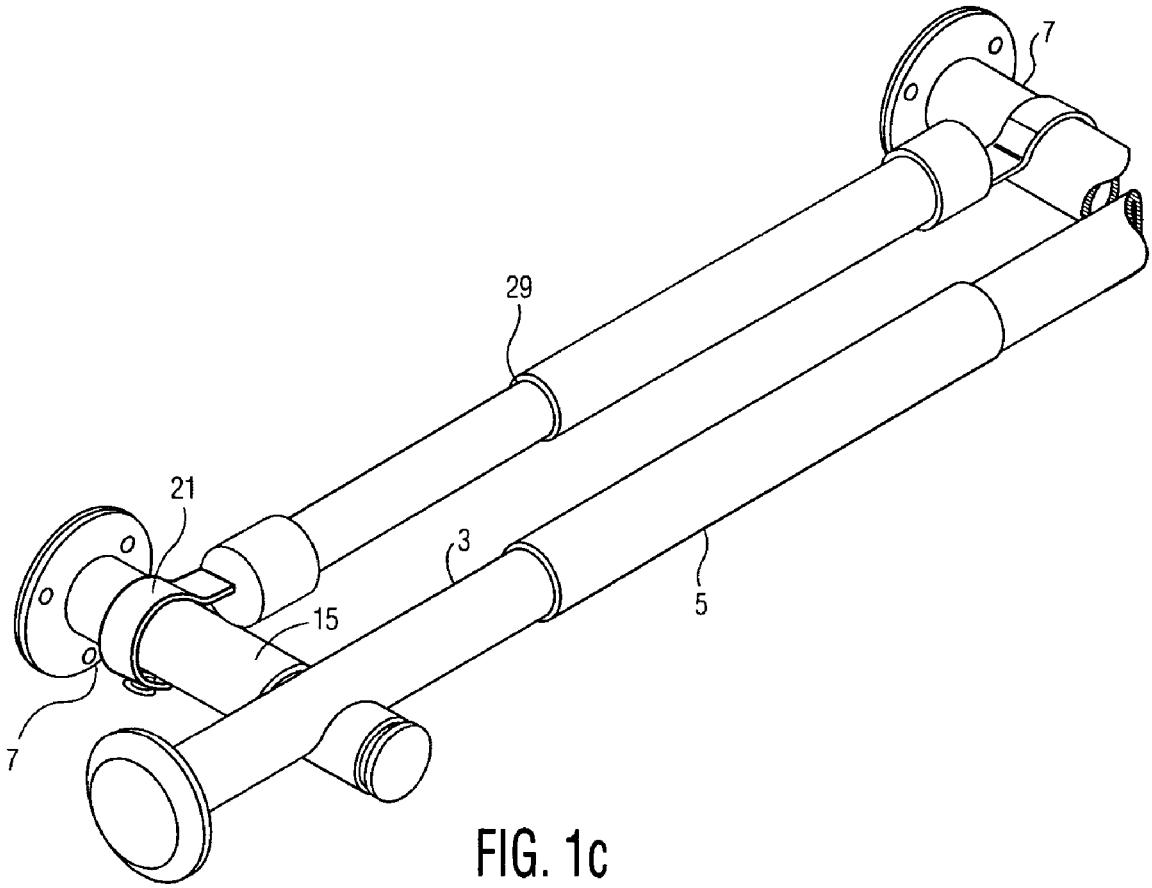
FIG. 1*c* is a perspective view of a variation of the first preferred embodiment of the invention.

In the embodiments shown in FIGS. 1*a*, 1*b*, 1*c*, the supplemental rod 29 has two segments, a smaller-diameter segment 27 and a larger-diameter segment 28, the segment 27 being snugly slidably received in the segment 28 to permit the supplemental rod 29 to be telescoped for adjusting its length. In installations where the distance between the brackets 7 is relatively small, e.g. in front of a narrow window, it may be possible to use a supplemental rod having only one segment.

In order to minimize costs and enhance the utility of the connectors 19, the invention provides for identical connectors 19 to be used on rods having segments of different diameters. An adaptor in the form of a bushing 37 is provided to enable the same connector 19 to be used on each end of a supplemental curtain rod 29, irrespective of whether all or fewer than all of its segments are used. This enables both end caps 25 to have inner diameters which are substantially equal to the outer diameter of the segment 28 of the supplemental curtain rod having the largest outer diameter. The hollow cylindrical bushing 37 serves as an adapter for enabling a connector 19 dimensioned for mounting on the supplemental curtain rod segment 28 having the largest outer diameter to be mounted on a supplemental curtain rod having a smaller outer diameter. The bushing 37 has an inner diameter substantially equal to the outer diameter of the supplemental curtain rod segment 27 having a smaller outer diameter and an outer diameter substantially equal to the outer diameter of the supplemental curtain rod segment 28 having the largest outer diameter. The bushing 37 is preferable made of plastic for reduced cost and weight, but other materials will suffice as will be known to those skilled in the art.

The connectors 19 may be used on both ends of the segment 28 having the largest outer diameter when that segment 28 is used alone. Alternatively, the connectors 19 may be used on both ends of a telescoping supplemental curtain rod having a smaller diameter segment 27 slidable within a larger diameter segment 28. In the latter case, the bushing 37 would be used on the free end of the smaller diameter segment 27.

Still greater flexibility in length of the supplemental rod may be had by telescoping two smaller diameter segments within a central larger diameter segment 28. In this case, two bushings 37 can be provided for use on the free ends of the two smaller diameter segments 27 when all three segments are in use.

The connectors 19 need not be limited to being suspended on the inner cylindrical tube of the wall mounted bracket 7. As can be seen in FIG. 1*c*, the supplemental rod 29 is supported, at each of its ends, by a respective connector 19 having a hook 21 bent to conform to the outer circumference of the bracket 7's sliding outer cylindrical tube 15.

Figure 6A:
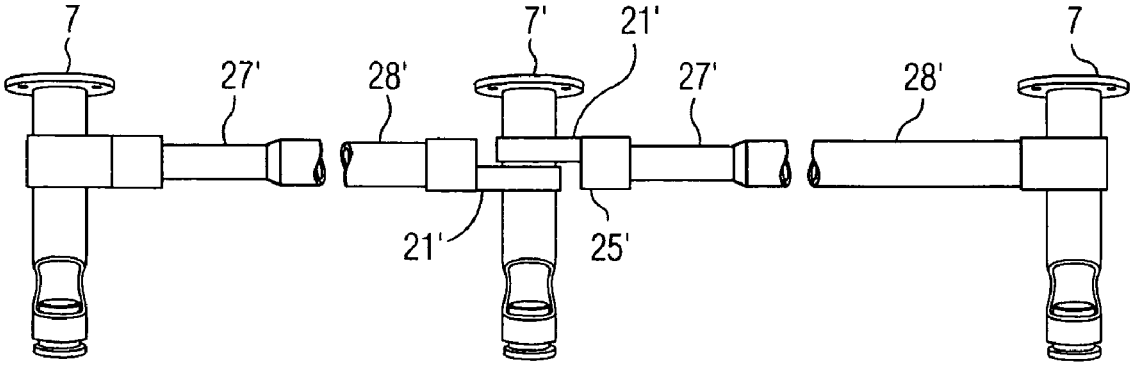
FIG. 6*a* is a plan view of the first preferred embodiment of the invention.

Referring now to FIG. 6*a*, there is shown an installation in which a two supplemental curtain rods, each having two segments 27',28', are mounted end to end to accommodate a very wide set of curtains (not shown). In order to prevent sagging in the center of an overly long curtain rod suspended only at its opposite ends, a central bracket 7' is wall mounted intermediate two wall mounted end brackets 7. The central bracket 7' supports one end of each of the two supplemental curtain rods while the end brackets 7 support respective opposite ends of the supplemental curtain rods.

Figure 5:
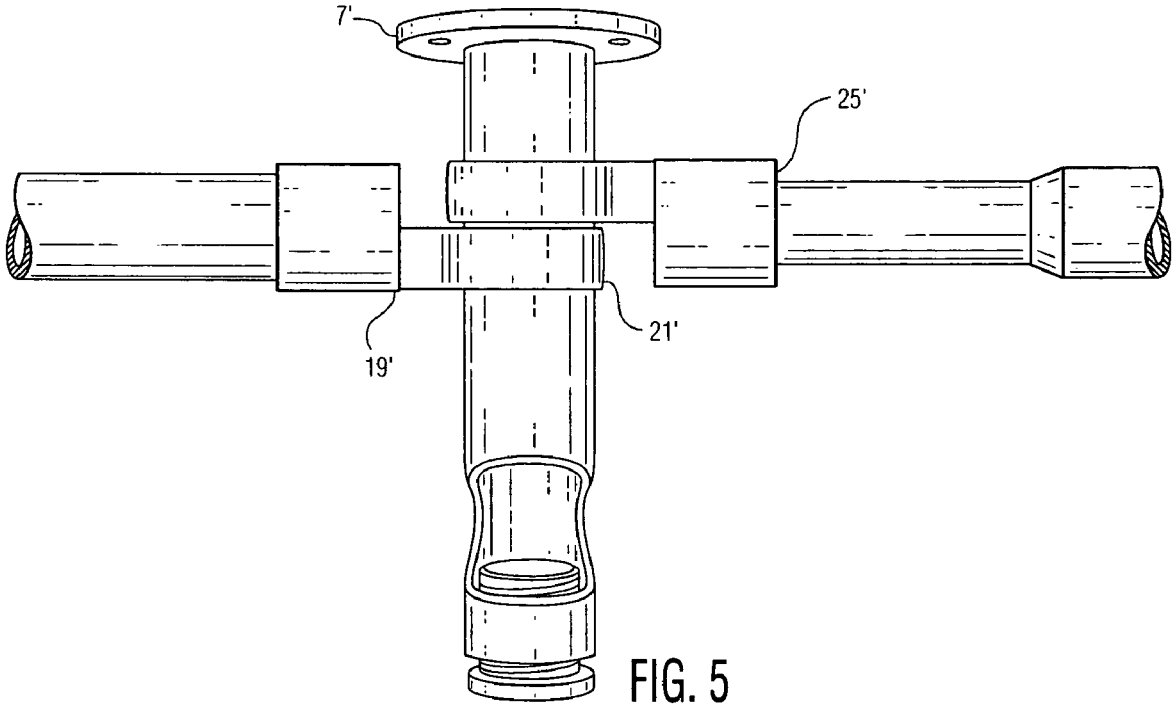
FIG. 5 is an enlarged plan view of a portion of the first preferred embodiment of the invention.

Referring additionally to FIG. 5, the hooks 21' on the end caps 25' of the connectors 19' used to support the ends of the supplemental curtain rods on the center bracket 7' are offset from the center of the end cap 25' and each hook 21' has a width approximately equal to, or slightly less than, one half the diameter of the end cap 25' whereby two identical connectors 19' facing in opposite directions as shown in Figs. and can be mounted side by side over a common center bracket 7' with the cylindrical axes of their end caps 25', and the axes of the curtain rods mounted within the end caps 25', in alignment for uninterrupted continuity in the appearance of the curtains hung on the rods.

Figure 6B:
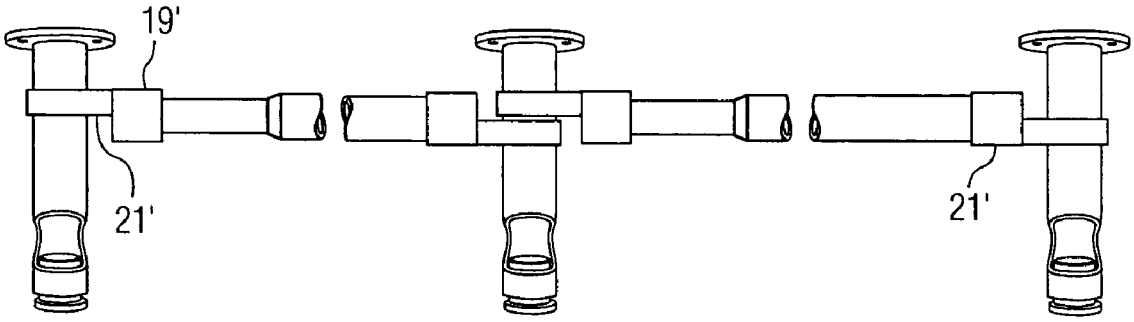
FIG. 6*b* is a plan view of a variation of the first preferred embodiment of the invention.
Figure 7A:
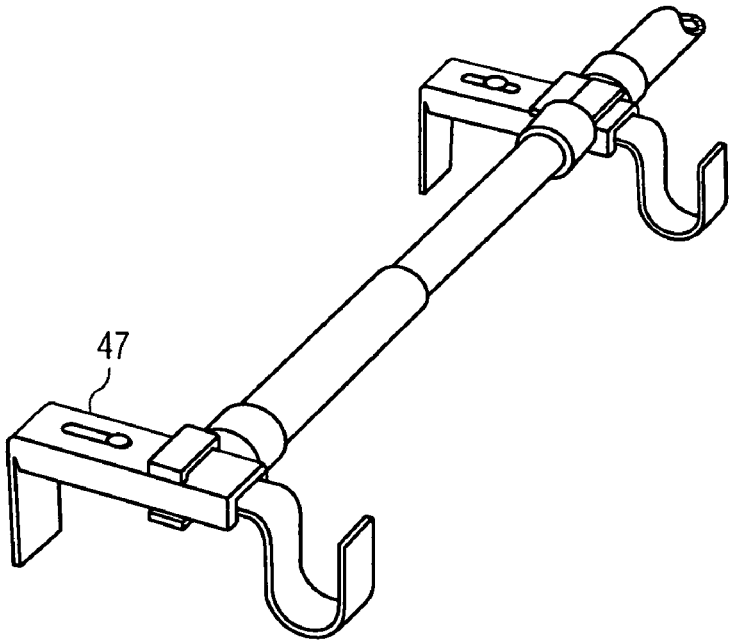
FIG. 7*a* is a perspective of a second preferred embodiment of the invention.
Figure 7B:
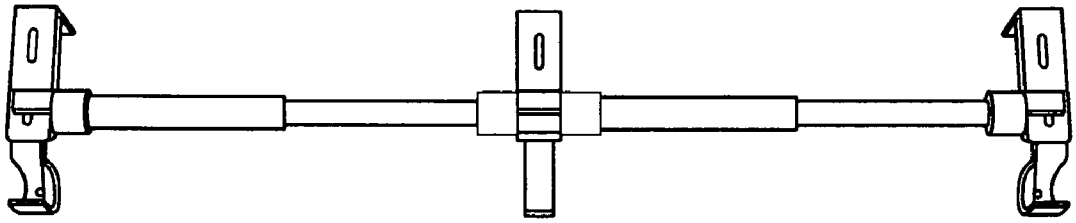
FIG. 7*b* is a plan view of the second preferred embodiment of the invention.

The use of connectors 19' with hooks 21' offset from the centers of the end caps 25' need not be limited to center brackets 7'. As can be seen in FIG. 6*b*, connectors 19' with offset hooks 21' can serve equally well in supporting supplemental curtain rods on end brackets 7.

The method and apparatus of the invention for mounting a supplemental curtain rod on an already mounted wall bracket is not limited to brackets having cylindrical members. Referring now to FIGS. 7-10, there is shown a curtain installation with a main right angle wall bracket 47 (see FIGS. 8*a*,*b*) including a forward projecting member 53 having a substantially rectangular cross section with a channel for receiving a slider 55 terminating in a U-shaped holder 54 for receiving a main curtain rod (not shown).

Figure 8A:
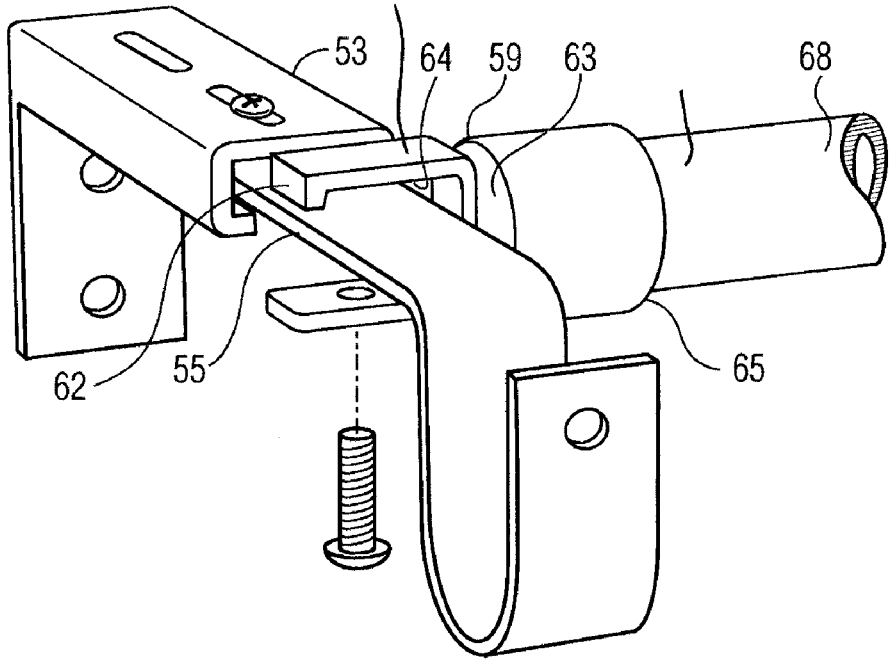
FIG. 8*a* is an enlarged perspective of the second preferred embodiment of the invention in a first stage of assembly.
Figure 8B:
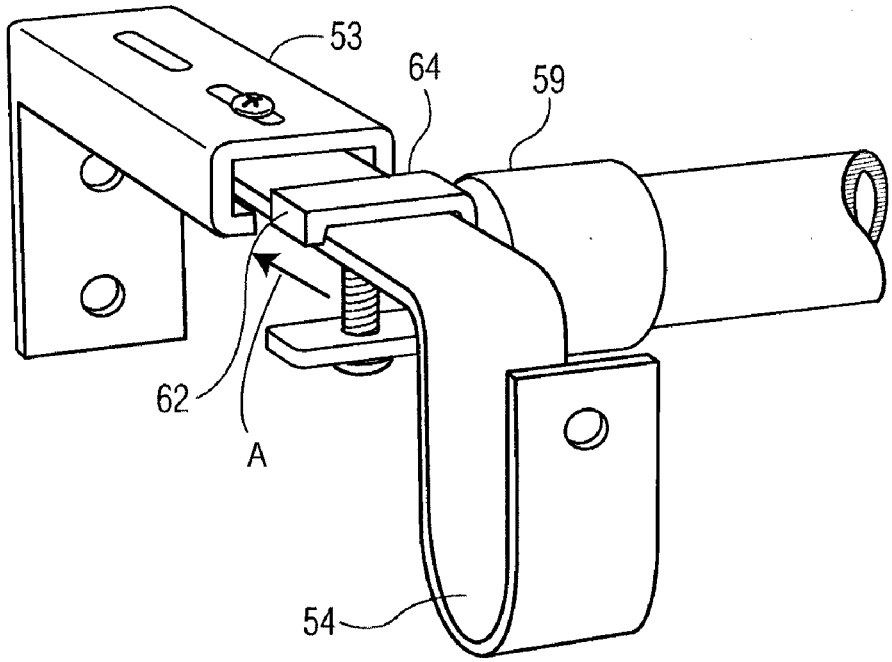
FIG. 8*b* is an enlarged perspective of the second preferred embodiment of the invention in a second stage of assembly.
Figure 9A:
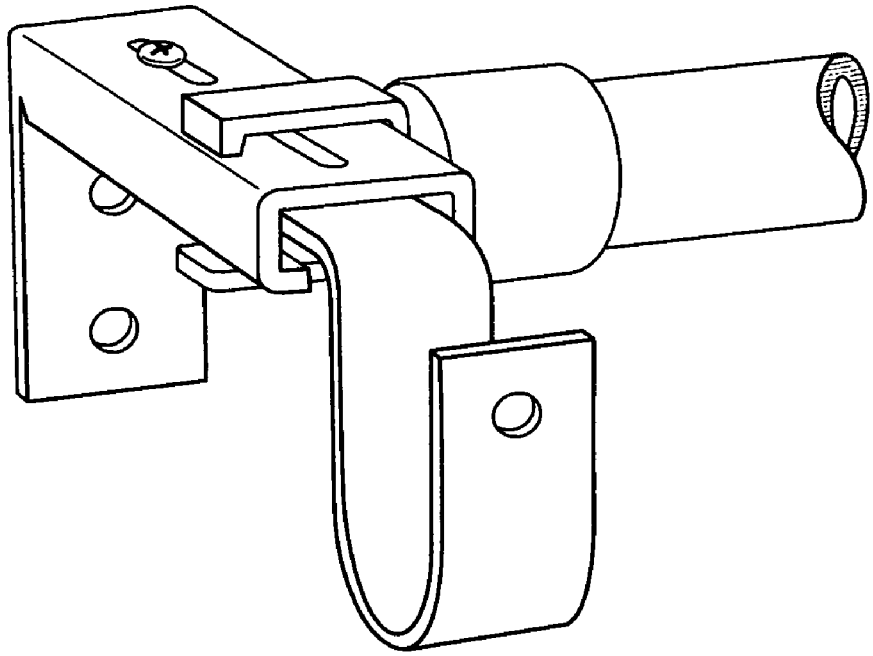
FIG. 9*a* is an enlarged top perspective of a variation of a portion of the second preferred embodiment of the invention.
Figure 9B:
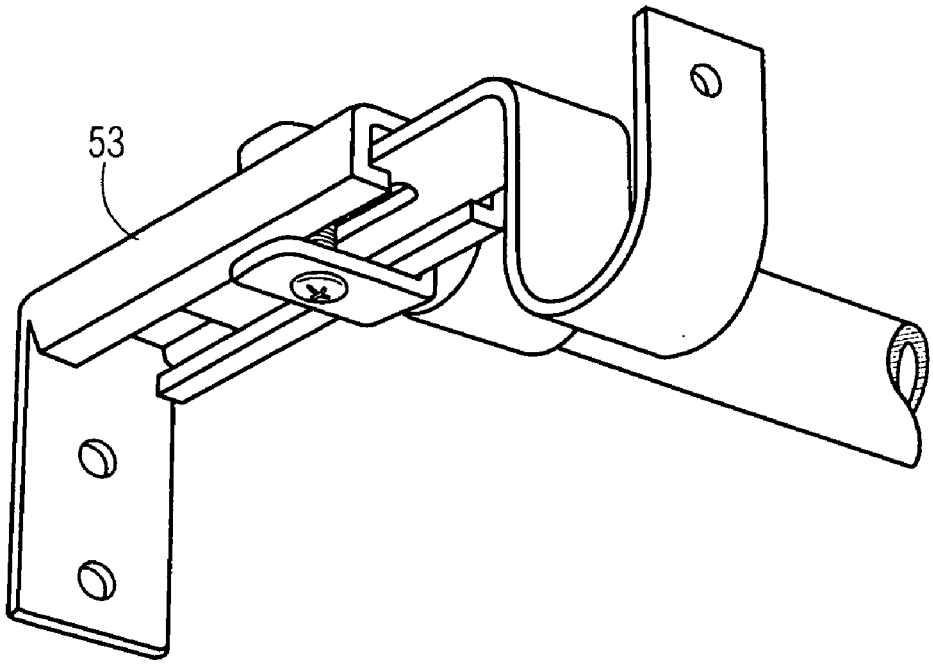
FIG. 9*b* is an enlarged bottom perspective of a variation of a portion of the second preferred embodiment of the invention.

There is removably mounted on the slider 55 of the bracket 47, as shown in FIGS. 8*a*,*b* connector 59 having a C-clamp 61 extending from the closed end 63 of a hollow cylindrical end cap 65 in which one end of a hollow cylindrical segment 68 of a supplemental curtain rod 69 is received. One of two parallel members of the C-clamp 61 has a lip 62 for forming a channel 64 having a width substantially equal to the width of the slider 55 through which the slider 55 freely extends as can be seen in FIGS. 8*a,b*. As can further be seen in FIG. 10*b*, C-clamp 61 is laterally offset from the axis of the connector 59 in a direction A parallel to the channel 64 and transverse to its width. The other parallel member of the C-clamp 61 is apertured for receiving a set screw 66 that can be tightened against the underside of the slider 55 for securing the connector 59 to the bracket 47. In FIGS. 8*a,b* and 10*d* the C-clamp 61 is secured only to the slider 55. In the views of FIGS. 9*a*, 9*b* and 10*c*, the C-clamp 61 is secured to both the slider 55 and forward projecting member 53. In the view of FIGS. 9*a*, 9*b* and 10*c*, the C-clamp 61 is secured to both the slider 55 and forward projecting member 53.

Figure 10A:
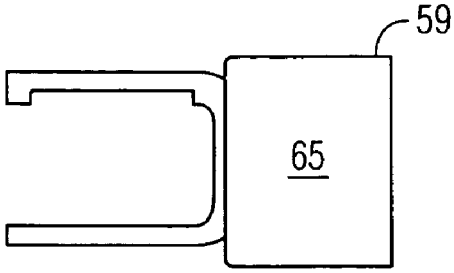
FIG. 10*a* is an elevation view of a component of the second preferred embodiment of the invention.
Figure 10B:
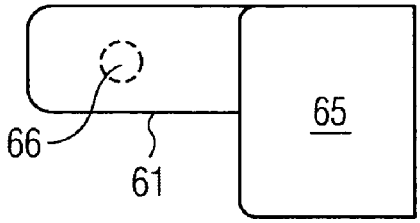
FIG. 10*b* is a plan view of the component of the second preferred embodiment of the invention shown in FIG. 10*a*.
Figure 10C:
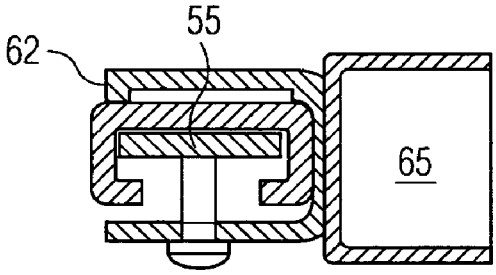
FIG. 10*c* is a sectional elevation view of one variation of assembled components of the second preferred embodiment of the invention.
Figure 10D:
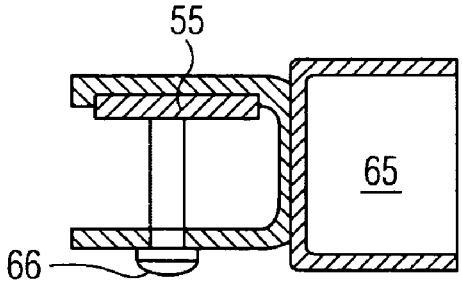
FIG. 10*d* is a sectional elevation view of another variation of assembled components of the second preferred embodiment of the invention.

As can best be seen in FIG. 10*b*, the parallel members of the fork-like C-clamp 61 are offset from the cylindrical axis of the end cap 65 to enable alignment of longitudinally adjacent rods mounted with the aid of an intermediate wall bracket 47' to prevent sagging in a manner similar to that disclosed with respect to the hooked connectors 21, 21' discussed with respect to FIGS. 1-6.

It is to be appreciated that the hook 21 and C-clamp 61 are two of many possible variations of connectors and mounts that can be attached to a holder for the end of a supplemental curtain rod for enabling the ends of the rod to be supported on a conventional wall bracket as will be known to one skilled in the art, with knowledge of the disclosure herein contained.

Figure 11:
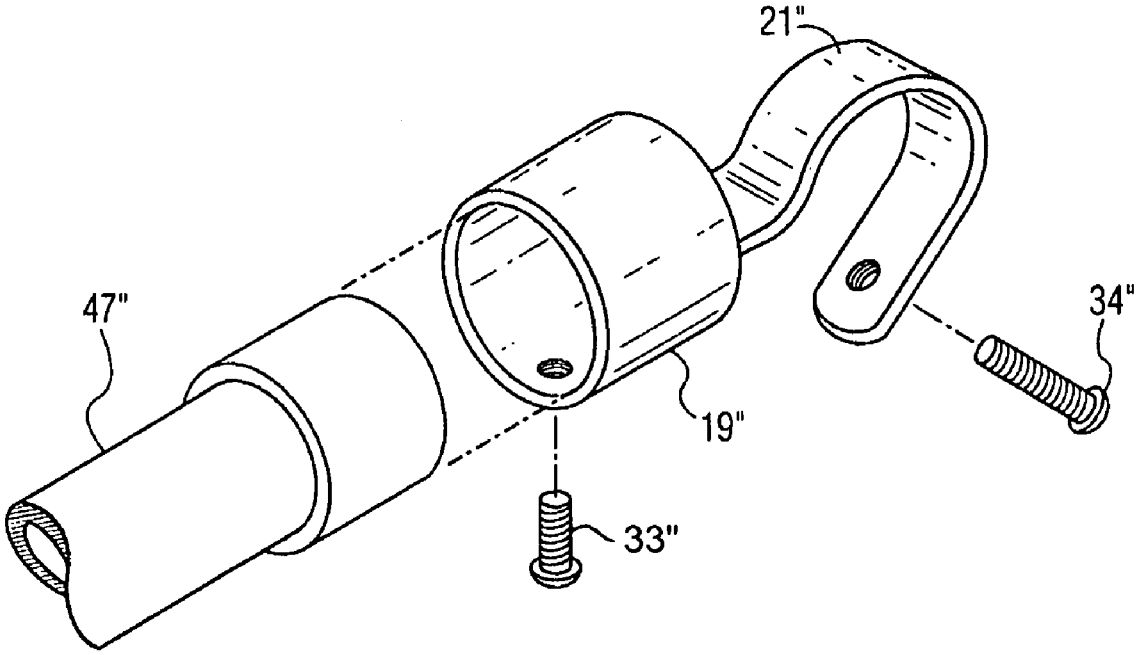
FIG. 11 is an exploded perspective view of a component of a third embodiment of the invention.
Figure 12:
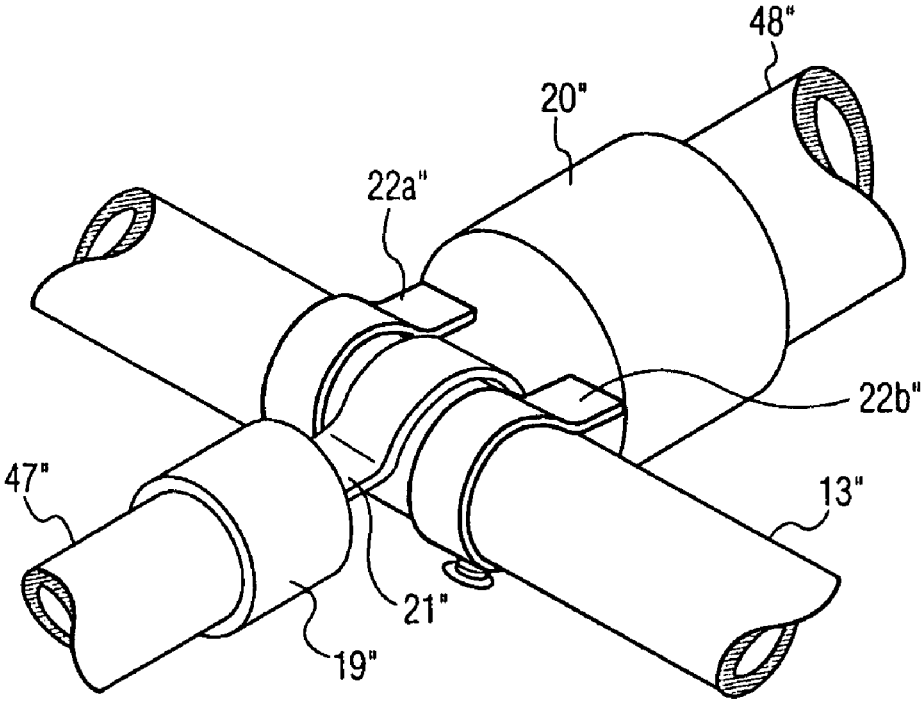
FIG. 12 is a perspective assembly view of the third embodiment of the invention.

Referring now to FIG. 11 there is shown an inner segment 47" of a curtain rod received in a hollow cylindrical bushing 37" which serves as an adapter for enabling a connector 19" dimensioned for mounting on an outer segment of a telescoping curtain to be mounted on the inner segment 47". A hook 21" is mounted on a diameter of the closed end surface of the connector 19" and centered with respect to a plane of the longitudinal axis of the connector 19". A set screw 33" is provided for fixing the connector 19" to the outer circumference of the adapter bushing 37". Referring additionally to FIG. 12, a second set screw 34" is optionally provided for securing the hook 21" to a mounting tube extending from a wall bracket intended to support the ends of two axially aligned curtain rods.

As can be seen in FIG. 12, the bushing 19" can have an inner diameter substantially equal to the outer diameter of an inner segment 47" of a telescoping curtain rod thereby enabling an end of the inner segment 47" to be snugly received in the connector 19". The hook 21" is disposed between two hooks 22*a*", 22*b*" which are mounted in spaced symmetrical relationship on a connector 20" of the end of a segment 48" of another curtain rod. The connector 20" and dual hooks 22*a*" and 22*b*" form a claw which grasps the mounting tube 13" with the segments 47" and 48" mounted in axial alignment.

It is to be appreciated that the foregoing is a description of three embodiments of the invention to which other variations and modifications may be made without departing from the spirit and scope of the invention.

What is claimed is:

1. A curtain rod comprising:

an elongated body having two ends;

one end having a first securing means for securing said curtain rod one end on a first wall bracket, said first securing means having an unobstructed channel for a first wall bracket, said first securing means extending from an end of said one end in a direction parallel to said channel and being laterally offset from one side of a central axis of said one end and laterally offset to a second securing means on the second end of said curtain rod; and a second end having a second securing means opposite said one end, said second securing means having an unobstructed channel for a second wall bracket, said second securing means extending from an end of said second end in a direction parallel to said channel and being laterally offset to tone side of said central axis of said second end and laterally offset to said one securing means; wherein said first and second securing means include hooks.

2. The curtain rod of claim 1 wherein said curtain rod is a telescoping curtain rod having (i) at least two rod segments, one of said rod segments having a smaller diameter than the other of said rod segments, and (ii) at least two connectors comprising an adaptor having a hollow bore, an inner diameter of said adaptor being substantially equal to an outer diameter of said one of said rod segments, and an outer diameter of said adaptor being substantially equal to an outer diameter of said other of said rod segments, whereby said connector may be mounted with said adapter on a free end of said one rod segment, and said connector may be mounted on a free end of said other rod segment without said adaptor.

3. The curtain rod of claim 1 wherein said first and second securing means conform to the shape of the wall brackets.

4. The curtain rod of claim 1 wherein said hooks are c-shaped, u-shaped, angular, or combinations thereof.

5. The curtain rod of claim 3 wherein said hooks are c-clamps.

6. The curtain rod of claim 1 wherein said securing means further include at least one aperture and at least one faster.

7. The curtain rod of claim 6 wherein said fastener levels the curtain rod on the wall brackets such that said curtain rod may be parallel to a second curtain rod in front of said curtain rod.

8. The curtain rod of claim 7 wherein said fastener is a screw.

9. An apparatus for hanging curtains comprising:

at least three wall brackets;

a first curtain rod having two ends, each end having a securing means for securing said first curtain rod on two of said wall brackets, said securing means having an unobstructed channel for said wall brackets, said securing means extending from an end of said one end in a direction parallel to said channel and being laterally offset from one side of a central axis of said first curtain rod and laterally offset to the other securing means on the opposite end of said first curtain rod; and a second curtain rod having two ends, each end having a securing means for securing said second curtain rod on two of said wall brackets, said securing means having an unobstructed channel for said wall brackets, said securing means extending from an end of said one end in a direction parallel to said channel and being laterally offset from one side of a central axis of said second curtain rod and laterally offset to the other securing means on the opposite end of said second curtain rod, whereby said two curtain rods are aligned with each other, and each securing means on said ends of said curtain rods are offset from one another so that the securing means are aligned on a common wall bracket; wherein said securing means include hooks.

10. The apparatus of claim 9 wherein said curtain rods are a telescoping curtain rod having (i) at least two rod segments, one of said rod segments having a smaller diameter than the other of said rod segments, and (ii) at least two connectors comprising an adaptor having a hollow bore, an inner diameter of said adaptor being substantially equal to an outer diameter of said one of said rod segments, and an outer diameter of said adaptor being substantially equal to an outer diameter of said other of said rod segments, whereby said connector may be mounted with said adapter on a free end of said one rod segment, and said connector may be mounted on a free end of said other rod segment without said adaptor.

11. The apparatus of claim 9 wherein said securing means conform to the shape of the wall brackets.

12. The apparatus of claim 9 wherein said hooks are c-shaped, u-shaped, angular, or combinations thereof.

13. The apparatus of claim 12 wherein said hooks are c-clamps.

14. The apparatus of claim 9 wherein said securing means further include at least one aperture and at least one faster.

15. The apparatus of claim 14 wherein said fastener levels said curtain rod on said wall brackets such that said curtain rod may be parallel to another curtain rod in front of said curtain rod.

16. The apparatus of claim 14 wherein said fastener is a screw.

17. The apparatus of claim 9 further comprising (i) at least a fourth wall bracket and (ii) at least a third curtain rod having two ends, each end having a securing means for securing said third curtain rod on two of said wall brackets, said securing means having an unobstructed channel for said wall brackets, said securing means extending in a direction parallel to said channel and being laterally offset from the center of said third curtain rod and laterally offset to the other securing means on the opposite end of said third curtain rod, whereby said at least three curtain rods are aligned with each other, and each securing means on said ends of said curtain rods are offset from one another so that the securing means are aligned on a common wall bracket.

* * * * *